United States Patent [19]

Champonnois

[11] Patent Number: 4,880,379

[45] Date of Patent: Nov. 14, 1989

[54] METHOD FOR TRANSFORMING A ROTARY KILN INTENDED IN PARTICULAR FOR THE MANUFACTURE OF CEMENT, KILN OBTAINED BY THIS METHOD AND BURNING LINE EQUIPPED WITH THIS KILN

[75] Inventor: Michel Champonnois, Houilles, France

[73] Assignee: CLE, Courbevoie, France

[21] Appl. No.: 249,952

[22] Filed: Sep. 27, 1988

[30] Foreign Application Priority Data

Sep. 30, 1987 [FR] France ..... 87 13529

[51] Int. Cl.[4] ..... F27D 1/16; F27D 15/02; F27B 15/00

[52] U.S. Cl. ..... 432/3; 432/80; 432/110

[58] Field of Search ..... 432/103, 104, 80, 14, 432/110, 3

[56] References Cited

U.S. PATENT DOCUMENTS

| | | | |
|---|---|---|---|
| 1,727,217 | 9/1929 | Price | 432/110 |
| 2,503,686 | 4/1950 | Raypholtz | 432/110 |
| 3,932,116 | 1/1976 | Hansen | 432/80 |
| 4,059,397 | 11/1977 | Adler | 432/80 |
| 4,578,029 | 3/1986 | Fujisawa | 423/14 |

FOREIGN PATENT DOCUMENTS

| | | | |
|---|---|---|---|
| 1783005 | 3/1971 | Fed. Rep. of Germany | 27/734 |
| 28679 | 1/1924 | France . | |
| 2553501 | 4/1984 | France | 27/720 |

OTHER PUBLICATIONS

J. C. Coulomb, Rapport De Recherche; Republique Francaise, *Institut National De La Propriete Industrielle*, Jun. 23, 1988.

*Primary Examiner*—Henry C. Yuen
*Attorney, Agent, or Firm*—Kenyon & Kenyon

[57] ABSTRACT

The present invention concerns a method for transforming a rotary kiln equipped with a planetary cooler and intended in particular for the manufacture of cement, a kiln obtained by this method and a burning line equipped with this kiln, the kiln being constituted by an inclined rotary tube through which the material flows and which is heated inwardly, this tube comprising a downstream section constituting a burning zone having a smaller diameter than that of the upstream section constituting a material preparation zone, both sections being connected by a conical part, and the downstream section having a diameter comprised between 4 and 5,1 meters and a length comprised between 20 and 50 meters.

1 Claim, 2 Drawing Sheets

Figure 1:
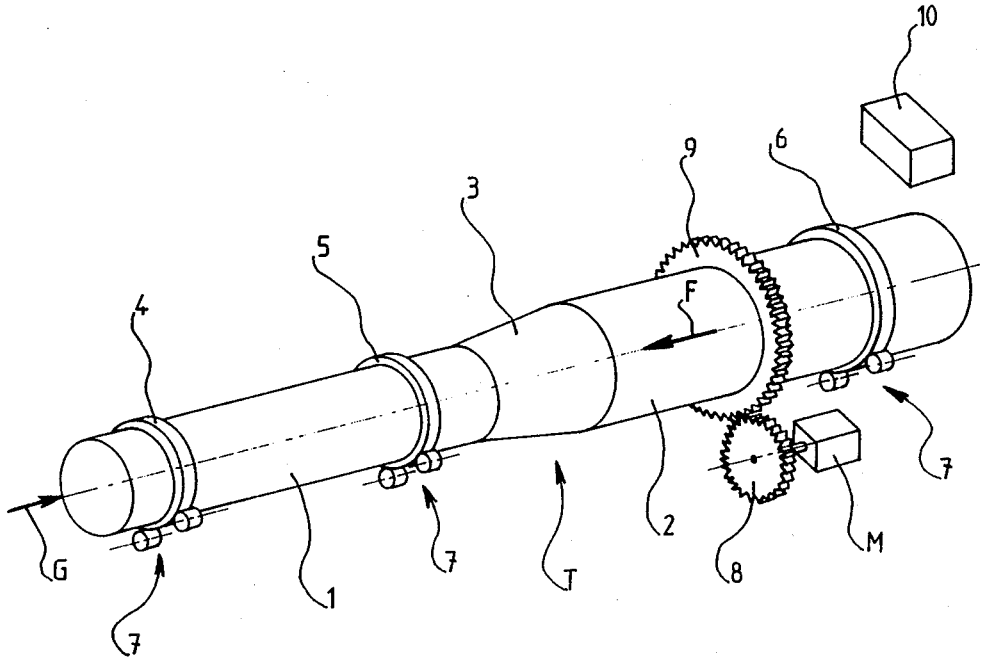

METHOD FOR TRANSFORMING A ROTARY KILN INTENDED IN PARTICULAR FOR THE MANUFACTURE OF CEMENT, KILN OBTAINED BY THIS METHOD AND BURNING LINE EQUIPPED WITH THIS KILN

The present invention relates essentially to a method for transforming a rotary kiln intended for example for the manufacture of cement and of the type constituted by a tube which is carried by rolling bearings and which is equipped at one of its ends with a cooler of the planetary type or with ballonets.

The invention relates also to a kiln resulting from the above transformation.

It relates also to a burning line equipped with such a kiln.

It has been already proposed to produce cement clinker in burning lines the capcity of which exceeds 2.500 ton/day, by using kilns with an inner diameter larger than 5,1 meters.

Generally these kilns are formed of an inclined sheet metal tube which comprises an inner refractory brick coating and which is rotated by appropriate means.

These kilns with a diameter larger than 5 meters present a number of drawbacks in relation in particular with the poor mechanical strength of the equipments in the hottest zone of the kiln.

The crust which appears on the brick coating during the burning and which is besides indispensable, is relatively thin when compared to that of a kiln with a smaller diameter, because the vault effect is less important. It results therefrom that the crust deteriorates all the more as, in kilns with a larger diameter, the brickwork is strongly stressed by the thermal load, and that much more than in the case of kilns with a smaller diameter.

Besides, it is known that this kind of rotary kiln comprises generally bands resting on rollers or the like permitting the rotation of the kiln. Therefore, it is understood that, in the case of kilns with a large diameter, the bands carried by the rollers tend to become ovalized, so that the brickwork and crust assembly is submitted to alternating mechanical stresses which are all the more important as the kiln is larger.

Moreover, the premature deformations or wear of the mechanical connections, and in particular of the band-tube connection, contribute to the increase of the ovalization of the kiln at the bands, which consequently causes the refractory coating of the kiln to become fragile.

All these drawbacks substantially increase the maintenance costs of the kiln and much reduce the operation rate, and therefore the economy of operation of the plant.

On the other hand, it is to be noted that, in the known kilns with a very large diameter, the effect of the precalcination upstream of the kiln remains relatively weak due to the unfavourable factors of mechanical origin in relation with the large diameter of the kiln in the burning or clinkering zone.

The present invention has for an object to remedy these drawbacks by providing a method for transforming a rotary kiln which permits obtaining a kiln the brickwork stability and the operation regularity of which are markedly better and the ovalization of which in the burning zone is strongly lowered if not suppressed.

For this purpose, the invention relates to a method for transforming a rotary kiln intended for example for the manufacture of cement and constituted by a tube carried by rolling bearings and provided at one of its ends with a cooler of the planetary type for example, characterized in that it consist in:

suppressing the cooler at the end of the tube and the portion of tube which is associated therewith, which has as an effect to markedly increase the load carried by the bearing located at the central part of the tube, cutting the said tube substantially at the central part thereof, and replacing one of the parts of the tube so cut by at least one tube section with a smaller diameter than that of the remaining part of the tube which is retained and which is connected to the said section, so that the load carried by the bearing of the said section at the said central part be reduced to a lower value and substantially identical to the initial value of the load carried by the bearing at the central part of the kiln equipped with the cooler and used for carrying out the transformation.

It is therefore understood that it is possible to retain the same equipments for supporting and rotating the kiln obtained after transformation, except for a few modifications of minor importance.

Besides, the risk of ovalization is advantageously reduced which appeared in the kilns provided with a cooler solid with their downstream end, and that due to the advantageous distribution of the stresses applied.

It is still to be noted that, paradoxically, the production is maintained and can even be increased by increasing the speed of rotation of the kiln, while the diameter of this kiln has been partly reduced.

According to another feature of this method, the connection of the tube section of reduced diameter to the remaining and retained part of the tube is effected through the medium of a conical part.

It is to be precised here that the aforesaid tube section forming the downstream part of the kiln constitutes a zone for burning the material, whereas the remaining part of the tube forming the upstream part of the kiln constitutes a preparation zone.

According to still another feature of this method, a grate cooler is mounted, without being integrated into the kiln, as well as a pre-calcination system respectively at the downstream end and at the upperstream end of this kiln.

The invention relates also to a rotary kiln obtained by the method having the above features and of the type comprising essentially an inclined rotary tube which is inwardly heated and through which the material flows, characterized in that the downstream burning or clinering zone of this kiln is constituted by at least one tube with a smaller diameter than that of the upstream material preparation or pre-calcination zone.

It is therefore understood that the reduction of the diameter of the burning zone will advantageously stabilize the brickwork by reiforcing the vault effect which, associated to the increase of the speed of rotation of the kiln, will promote the formation of the crust and a better time stability of the same, so that the brickwork will finally be better protected.

According to another feature of this kiln, the diameter of the downstream burning zone is comprised between 75 and 95% of the diameter of the aforesaid upstream preparation zone.

As for the length of the burning zone, it is comprised between 30 and 60% of the total length of the kiln.

According to a preferred embodiment, the diameter of the downstream burning zone will be comprised between 4 meters and 5,1 meters and the length of the said zone will be comprised between 20 and 60 meters.

According to another featutre, there is provided between the burning and preparation zones, a conical connection part having a half angle comprised between 4 and 7 degrees.

According to still another feature of the invention, the kiln comprises three supporting and rolling bands for ensuring the rotation of the tube, two bands being disposed around the downstream burnin zone with a reduced diameter, so that the aforesaid connecting part be located in a zone where the bending moment is minimum.

The invention relates also to a burning line equipped with a rotary kiln having the above features, characterised in that it comprises upstream of the preparation or pre-calcination zone a pre-calcination system which is not integrated into the kiln.

Figure 2:
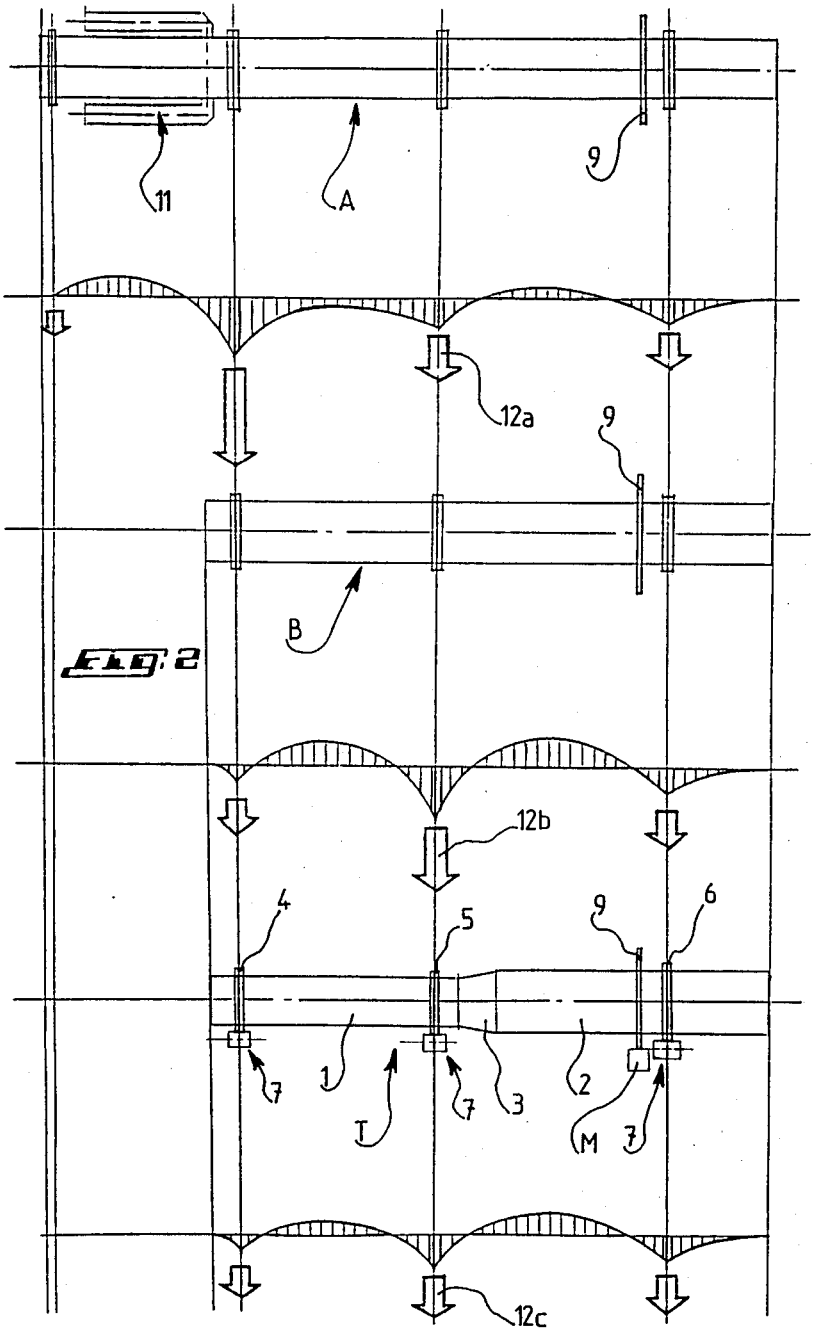

Other features and advantages of the invention will appear more clearly in the course of the following detailed description with reference to the appended drawings, given by way of example only, and wherein:

FIG. 1 is a very diagrammatic perspective view of a rotary kiln according to the principles of the invention; and FIG. 2 illustrates diagrammatically the essential steps of the transformation of a known kiln with a cooler with ballonets for obtaining a kiln according to the invention.

Referring to FIG. 1, it is seen that a kiln according to this invention is essentially constituted by an inclined rotary tube T through which the material flows in the direction of arrow F and which is heated inwardly and dowstream by a flame represented by arrow G.

The tube T comprises a burning or clinkering zone 1 forming the downstream section of the kiln, which is of a smaller diameter than the upstream tube or section 2 constituting the material preparation or pre-calcination zone.

The diameter of the downstream zone or section 1 can be comprised between 4 and 5,1 meters, and its length can be comprised between 20 and 60 meters.

The downstream 1 and upstream 2 sections are connected by a conical part 3 having a half angle which can be comprised between 4 and 7 degrees in order to permit forming a brickwork with standard bricks.

There is shown at 4, 5 and 6 bands surrounding tube T and resting respectively on rollers 7 thus permitting the rotation of tube T which is rotated by a motor M the output shaft of which actuates at least one pinion 8 meshing with an annular gear 9 solid with upstream section 2.

As clearly seen in FIG. 1, bands 4 and 5 are disposed around the downstream section or burning zone 1 whereas band 6 is disposed around the upstream section or preparation zone 2.

It is to be noted here that the median part of the kiln constituted by the connecting part 3 is located in a zone where the bending moment is minimum.

If a very strong reduction of the diameter of burning zone 1 is desired, it is possible to add upstream of section 1 another section (not shown) having a diameter comprised between the diameters of sections 1 and 2, it being understood that a conical connecting part such as 3 will be provided between these various sections.

A pre-calcination system or pre-heater which is not integrated into the kiln or tube T is shown diagrammatically at 10 in FIG. 1.

Thus, the pre-calcination of the material upstream of the kiln, the reduction of the diameter of the clinkering or burning zone 1 to an inner diameter smaller than or equal to 5,1 m, and also the increase of the speed of rotation of the kiln will permit obtaining an increase of the production.

However, for a better understanding of the invention, and referring to FIG. 2, the manufacture and the advantages of a kiln according to the invention will be described hereafter, which kiln is obtained by the transformation of an existing kiln shown at A in the upper part of FIG. 2 and provided at its downstream end with a planetary cooler or with a cooler with ballonets 11.

This kiln A with an integrated cooler 11 can be part of a clinker-burning line with a nominal capacity of 3.800 ton/day and can have a total length of about 115 m and an inner diameter of 5,6 m. The speed of rotation of kiln A before being transformed amounted to 2 revolution/minute.

For obtaining the kiln T of the invention shown in FIG. 1 and in the lower part of FIG. 2, the cooler 11 of kiln A is suppressed, which cooler besides renders very critical the operation of this kiln, and the tube portion of kiln A which is associated to the cooler is suppressed too.

There is therefore obtained a lightened kiln B which appears in FIG. 2, but whose load supported by the bearing located at the central part of the kiln is substantially increased, as shown by arrows **12*a* and 12*b* in FIG. 2**. It is to be noted here that, in this figure, the curves shown under each kiln A, B and T represent the intensity of the bending moment at several points distributed along the length of the kilns, it being understood that the arrows located under the three curves have a dimension proportional to the importance of the loads at each of the bearing points.

Once the cooler 11 is suppressed as explained previously, the kiln B is cut substantially at its central part, and the downstream cut part, i.e. the left-hand part in FIG. 2, is replaced by a tube section, which is section 1 of kiln T, which section has a smaller diameter than that of the remaining part of the tube which is retained and which is connected to section 1. By proceeding in this way, the load on the median or central bearing of kiln T of the invention remains substantially identical to its former value on the corresponding bearing of kiln A, as represented by arrows **12*a* and 12*c*. In other words, the load carried by the bearing of section 1** with a reduced diameter at the central part of the kiln has been reduced to a substantially smaller value than in the case of kiln B and substantially identical to the initial value of the load carried by the bearing at the central part of kiln A used for carrying out the transformation.

According to an embodiement, the downstream section 1 of kiln T corresponds to a reduction of the diameter of the downstream section of kiln A to a diameter of 5 m along a length of 43 m, the total length of the transformed kiln obtained being then of about 90 m.

The connecting cone 3 between downstream section 1 with a diameter of 5 m and upstream section 2 whose diameter is retained (5,6 m), has a half angle of 4,8° and a length of 3,5 m. It is clearly seen in FIG. 2 that this cone 3 is actually located in a zone where the bending moment is reduced to zero (see the curve in the lower part of FIG. 2).

The speed of rotation of kiln T is increased with respect to that of kiln A from 2 revolutions/minute to 3,1 revolutions/minute, and the annular gear/pinion train is not modified.

Thus, for a given production and a same residence time of the material in the downstream burning and clinkering zone, the speed of rotation of the kiln, which is increased with respect to its value without modification of the diameter of the clinkering or burning zone, permits improving the thermal exchanges in the upstream preparation zone 2, whereas the residence time of the material is markedly reduced therein.

It is still to be noted that, for a given production, the thermal power available in the downstream clinkering zone is lower and that the pre-calcination rate of the material at the inlet of the kiln is therefore higher than its value without modification of the diameter of the clinkering zone.

It is still to be precised that the three bands or bearings 4, 5, 6 of kiln T are located respectively at 5 m, 34 m and 73,5 m from the downstream end of section 1. Before transformation, the loads on these bearings amounted respectively to 1.485 ton, 805 ton and 585 ton. After transformation, these loads became respectively 494 ton, 813 ton and 625 ton, which permitted retaining the civil engineering and the rollers or running carriage of these bearings.

A test for increasing the speed of a kiln has been also carried out, by passing from the previous production of 3.800 ton/day, to a production of 5.500 ton/day.

Therefore, according to the invention, a kiln has been made in a very simple manner, which can be obtained by transforming an existing kiln by reducing the diameter of the burning zone and which, owing to the simple operations of pre-calcination of the material upstream of the kiln and of increasing the speed of rotation of this kiln, can permit obtaining high rates of production, and that without modifying in a significant and costly way the mechanical systems for bearing and rotating the kiln.

Of course, the invention is by no means limited to the embodiment described and illustrated which has been given by way of example only.

Thus, without departing from the scope of the invention, it is possible to provide several downstream sections with a progressively reduced diameter and forming a burning zone, these sections having equal or different lengths.

Therefore, the invention encompasses all the technical equivalents of the means described as well as the combinations thereof provided that these are made according to its spirit.

What is claimied is:

1. A method for transforming a rotary kiln intended for said manufacture of any material such as cement and including a rotatable tube, rolling bearings, carrying a load, for supporting said tube at its central part and at its ends and a planetary cooler provided at one of said ends of said tube, this method comprising the steps of:

suppressing said cooler at said one end of said tube, and said tube portion which is associated therewith, to markedly increase said load carried by said bearing located at said central part of said tube;

cutting said tube substantially at said central part thereof to provide two tube portions having the same diameter;

replacing one of said tube portions by at least one tube section having a smaller diameter than that of said other tube portion which is retained;

connecting said tube section of smaller diameter to said other tube portion of larger diameter through a conical member and mounting said bearing at the central part of the tube onto said tube section, whereby said load carried by said bearing is reduced to a value which is lower than said increased load and substantially identical to the initial value of said load carried by the bearing at said central part of said initial kiln tube equipped with said cooler and used for carrying out said transformation.

* * * * *

UNITED STATES PATENT AND TRADEMARK OFFICE

CERTIFICATE OF CORRECTION

PATENT NO. : 4,880,379

DATED : November 14, 1989

INVENTOR(S) : Michel CHAMPONNOIS

It is certified that error appears in the above-identified patent and that said Letters Patent is hereby corrected as shown below:

| Column | Line | Corrections |
|---|---|---|
| ABSTR. | 12 | Change "comprised" to --of--; change "5,1" to --5.1". |
| ABSTR. | 13 | Change "comprised" to --of--. |
| 1 | 19 | Change "capcity" to --capacity--; change "2.500" to --2,500--. |
| 1 | 21 | Change "5,1" to --5.1--. |
| 2 | 18 | Change "be" to --is--; change "and" to --which is--. |
| 2 | 38 | Change "precised" to --noted--. |
| 2 | 58 | Change "reiforcing" to --reinforcing--. |
| 2 | 59 | Change "to" to --with--. |
| 2 | 64 | Delete "comprised". |
| 2 | 67 | Delete "comprised". |
| 3 | 3 | Change "5,1" to --5.1--. |
| 3 | 2,4, 43,44 | Delete "comprised". |
| 3 | 7 | Change "comprised" to --of--. |
| 3 | 12 | Change "burnin" to --burning--. |

UNITED STATES PATENT AND TRADEMARK OFFICE

CERTIFICATE OF CORRECTION

PATENT NO. : 4,880,379

DATED : November 14, 1989

INVENTOR(S) : Michel CHAMPONNOIS

It is certified that error appears in the above-identified patent and that said Letters Patent is hereby corrected as shown below:

| Column | Line | Corrections |
|---|---|---|
| 3 | 14 | Change "be" to --is--. |
| 3 | 43 | Change "5,1" to --5.1--. |
| 4 | 7 | Change "5,1" to --5.1--. |
| 4 | 19 | Change "3.800" to --3,800--. |
| 4 | 20 | Change "5,6" to --5.6--. |
| 4 | 64 | Change "5,6" to --5.6--; change "4,8°" to --4.8°--. |
| 4 | 65 | Change "3,5" to --3.5--. |
| 5 | 3 | Change "3,1" to --3.1--. |
| 5 | 19 | Change "precised" to --noted--. |

UNITED STATES PATENT AND TRADEMARK OFFICE

CERTIFICATE OF CORRECTION

PATENT NO. : 4,880,379

DATED : November 14, 1989

INVENTOR(S) : Michel Champonnois

It is certified that error appears in the above-identified patent and that said Letters Patent is hereby corrected as shown below:

| | | |
|---|---|---|
| 5 | 22 | Change "73,5" to --73.5--. |
| 5 | 24 | Change "1.485" to --1,485--. |
| 5 | 31 | Change "3.800" to --3,800--; change "5.500" to --5,500--. |

Signed and Sealed this

First Day of January, 1991

*Attest:*

HARRY F. MANBECK, JR.

*Attesting Officer*

*Commissioner of Patents and Trademarks*